US009214309B2

(12) United States Patent
Watford

(10) Patent No.: US 9,214,309 B2
(45) Date of Patent: Dec. 15, 2015

(54) TWO-POLE CIRCUIT BREAKER WITH TRIP BAR APPARATUS AND METHODS

(71) Applicant: Russell Thomas Watford, Lawrenceville, GA (US)

(72) Inventor: Russell Thomas Watford, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 225 days.

(21) Appl. No.: 14/024,094

(22) Filed: Sep. 11, 2013

(65) Prior Publication Data

US 2015/0068881 A1 Mar. 12, 2015

(51) Int. Cl.

| | |
|---|---|
| ***H01H 71/10*** | (2006.01) |
| *H01H 83/20* | (2006.01) |
| *H01H 71/12* | (2006.01) |

(52) U.S. Cl.

CPC ..... *H01H 71/1009* (2013.01); *H01H 71/1027* (2013.01); *H01H 83/20* (2013.01); *H01H 2071/124* (2013.01); *Y10T 29/49105* (2015.01)

(58) Field of Classification Search

CPC ..... H01H 17/525–17/528; H01H 73/12; B41J 7/24; B41J 7/02

USPC ..... 200/401–407; 345/172–176

See application file for complete search history.

(56) References Cited

U.S. PATENT DOCUMENTS

| | | | | |
|---|---|---|---|---|
| 3,840,833 | A * | 10/1974 | Mrenna et al. | 337/43 |
| 5,557,082 | A * | 9/1996 | Leet et al. | 200/50.35 |
| 7,515,022 | B2 | 4/2009 | Zindler | |
| 7,911,298 | B2 * | 3/2011 | Carlino et al. | 335/18 |
| 7,986,203 | B2 * | 7/2011 | Watford | 335/10 |
| 8,369,052 | B2 | 2/2013 | McCoy | |
| 2008/0122563 | A1 * | 5/2008 | Song | 335/176 |

* cited by examiner

*Primary Examiner* — Edwin A. Leon
*Assistant Examiner* — Iman Malakooti

(57) ABSTRACT

A two-pole circuit breaker has an internal rotating trip bar that causes a second pole to trip (i.e., interrupt power) in response to a first pole tripping. A first pole may trip when the two-pole circuit breaker senses an electrical fault in the first pole. The tripping of the second pole in response to the first pole tripping may be referred to as common tripping. The trip bar may be connected to a tripping mechanism in each pole and may have interface features that result in less force required to trip the second pole, greater trip bar design tolerances, and/or ultimately more reliable common tripping. Methods of assembling a two-pole circuit breaker are also provided, as are other aspects.

20 Claims, 10 Drawing Sheets

TWO-POLE CIRCUIT BREAKER WITH TRIP BAR APPARATUS AND METHODS

FIELD

The invention relates generally to circuit breakers for interrupting power from an electrical power supply, and more particularly to two-pole circuit breakers.

BACKGROUND

Two-pole circuit breakers have two electrical branches or poles through which electrical power is provided to one or more loads. Residential two-pole circuit breakers in the U.S., for example, typically provide 240 volts instead of 120 volts to devices and/or appliances such as electric dryers, water heaters, well pumps, and/or electric ranges. When an electrical fault is sensed in one pole, the two-pole breaker typically "trips" both poles (i.e., interrupts power through both poles). This is often referred to as a common trip, which helps to prevent electrical shock hazards and/or equipment damage when a hazardous electrical condition is sensed by the breaker.

Two-pole circuit breakers usually have an internal rotating trip bar that causes the second pole to trip in response to the first pole tripping. Trip bars are typically connected to a tripping mechanism in each pole and may require tight design tolerances and precise alignment in order to function properly. Accordingly, trip bars may require careful monitoring and inspection during production and assembly. Tooling may be difficult to maintain with tight design tolerances, and batches of produced trip bars may be subject to rejection for not meeting stringent design specifications. Trip bars may also be subject to surface wear during use that may render the trip bar unable to trip the second pole.

A need therefore exists to provide an improved trip bar in two-pole circuit breakers.

SUMMARY

According to one aspect, a two-pole circuit breaker is provided. The two-pole circuit breaker includes a first mechanical pole comprising a first armature and a first cradle, the first mechanical pole configured to trip in response to sensing an electrical fault; a second mechanical pole comprising a second armature and a second cradle, the second mechanical pole configured to trip in response to sensing an electrical fault; and a trip bar mechanically coupled to the first and second mechanical poles, the trip bar configured to trip one of the first and second mechanical poles in response to the other of the first and second mechanical poles tripping, the trip bar having a first cradle interface having a first recessed surface and a first cradle contact surface; wherein one of the first and second cradles moves past the first recessed surface before contacting the first cradle contact surface during a trip.

According to second aspect, another two-pole circuit breaker is provided. The two-pole circuit breaker includes a first mechanical pole comprising a first armature and a first cradle, the first mechanical pole configured to trip in response to sensing an electrical fault; a second mechanical pole comprising a second armature and a second cradle, the second mechanical pole configured to trip in response to sensing an electrical fault; and a trip bar mechanically coupled to the first and second mechanical poles, the trip bar configured to trip one of the first and second mechanical poles in response to the other of the first and second mechanical poles tripping, the trip bar having a pivot end and a distal end opposite the pivot end, the trip bar having a first armature interface that has a first protruding armature contact surface at the distal end.

According to a third aspect, a method of assembling a two-pole circuit breaker is provided. The method includes providing a first mechanical pole that includes a first armature and a first cradle, the first mechanical pole configured to trip in response to sensing an electrical fault; providing a second mechanical pole that includes a second armature and a second cradle, the second mechanical pole configured to trip in response to sensing an electrical fault; and coupling mechanically one end of a trip bar to the first mechanical pole and another end of the trip bar to the second mechanical pole, the trip bar having a first cradle interface having a first recessed surface and a first cradle contact surface, wherein one of the first and second cradles is configured to move past the first recessed surface before contacting the first cradle contact surface during a trip.

Still other aspects, features, and advantages of the invention may be readily apparent from the following detailed description wherein a number of example embodiments and implementations are described and illustrated, including the best mode contemplated for carrying out the invention. The invention may also be capable of other and different embodiments, and its several details may be modified in various respects, all without departing from the scope of the invention. Accordingly, the drawings and descriptions are to be regarded as illustrative in nature, and not as restrictive. The invention covers all modifications, equivalents, and alternatives falling within the scope of the invention.

BRIEF DESCRIPTION OF DRAWINGS

The drawings, described below, are for illustrative purposes only and are not necessarily drawn to scale. The drawings are not intended to limit the scope of the invention in any way.

DETAILED DESCRIPTION

Figure 1A:
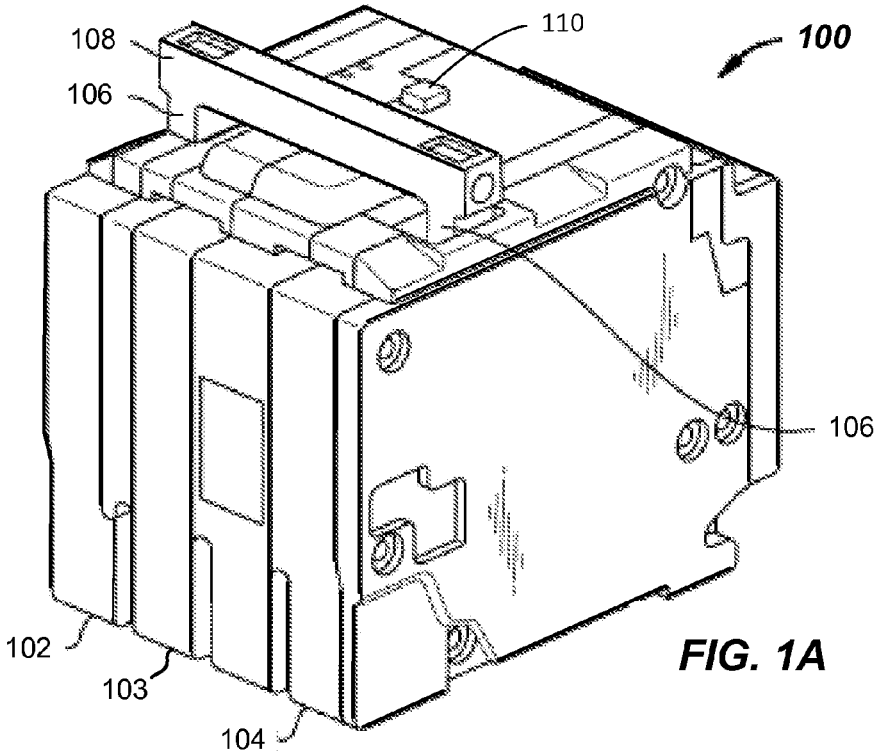
FIGS. 1A and 1B illustrate perspective right-side and left-side views, respectively, of a two-pole circuit breaker according to embodiments.

Reference will now be made in detail to the example embodiments of this disclosure, which are illustrated in the accompanying drawings. Wherever possible, the same reference numbers will be used throughout the drawings to refer to the same or like parts.

In one aspect, a two-pole circuit breaker may include a first mechanical pole and a second mechanical pole. Each mechanical pole may provide electrical power there through to one or more loads. For example, each pole may provide 120 volts, which together provide 240 volts, to a device and/or appliance, such as a water heater or electric clothes dryer, that requires 240 volts in order to operate. Each pole may have components that can sense an electrical fault such as, e.g., a short circuit or current overload condition. Upon sensing an electrical fault, the mechanical pole "trips" (i.e., interrupts power there through). As the mechanical pole trips, a trip bar mechanically coupled to each of the first and second mechanical poles rotates, which causes the other mechanical pole to also trip. This may be known as a "common trip." Two-pole circuit breakers that do not common trip present a safety concern and accordingly should be not be used.

In some embodiments, two-pole circuit breakers may also have an electronic pole disposed between the first and second mechanical poles. The trip bar may extend through the electronic pole. The electronic pole may include a detector circuit that continuously monitors current flowing through each mechanical pole to sense electrical faults such as, e.g., a ground fault and/or an arc fault. In some embodiments, if an arc fault or a ground fault is sensed in either mechanical pole, the detector circuit may activate, e.g., a solenoid to trip a pre-designated one of the mechanical poles. As the pre-designated mechanical pole trips, the trip bar rotates causing the other mechanical pole to also trip. In other embodiments, the solenoid may contact the trip bar directly and cause it to rotate, which may cause both the first and second mechanical poles to trip.

The trip bar may interface with various components in the first and second mechanical poles, such as, e.g., a cradle and an armature of each mechanical pole. The trip bar may have interface features that result in less tripping force needed to perform a common trip, more allowable trip bar design tolerance, and/or ultimately more reliable common tripping. For example, in some embodiments, the trip bar may have a cradle interface that allows a cradle to rotate further during a trip before contacting the cradle interface. This may result in the cradle contacting the cradle interface with more force to ensure that a common trip occurs. In some embodiments, the trip bar may have an armature interface that contacts an armature at a position farther away from the armature's pivot point such that less force may be required to move or bend the armature to perform a common trip. In some embodiments, the trip bar may have interface features that may increase the distance or amount that an armature moves or bends during a common trip (which may be referred to as "de-latch bite over travel," described in detail further below). This may lessen the adverse effect of trip bar surface wear on the trip bar's ability to perform a common trip.

In other aspects, methods of assembling a two-pole circuit breaker are provided, as will be described in greater detail below in connection with FIGS. 1-14.

Figure 1B:
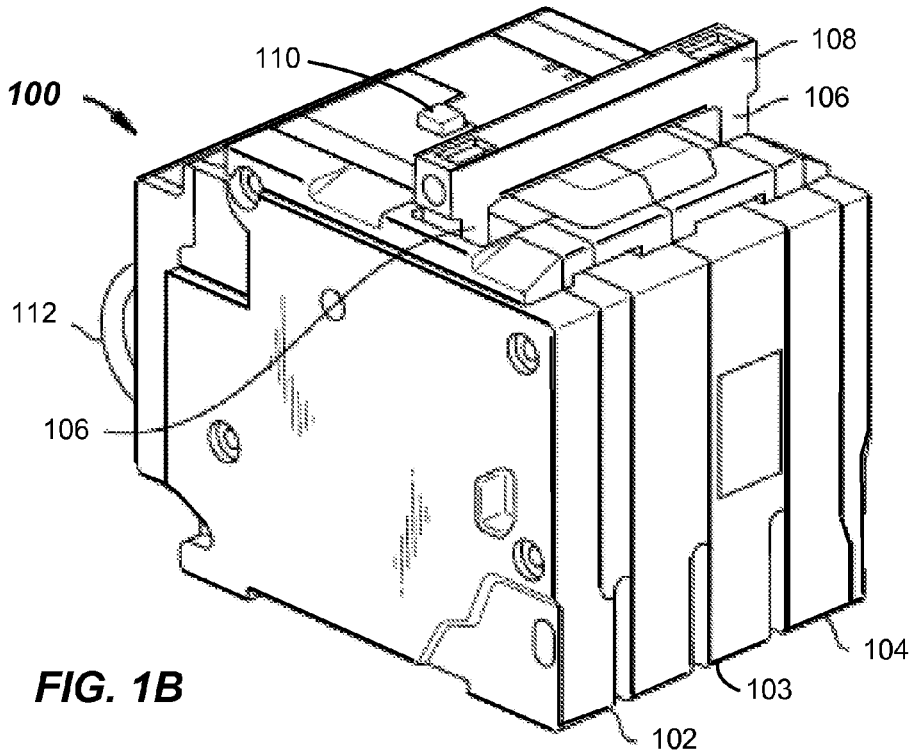
Figure 2:
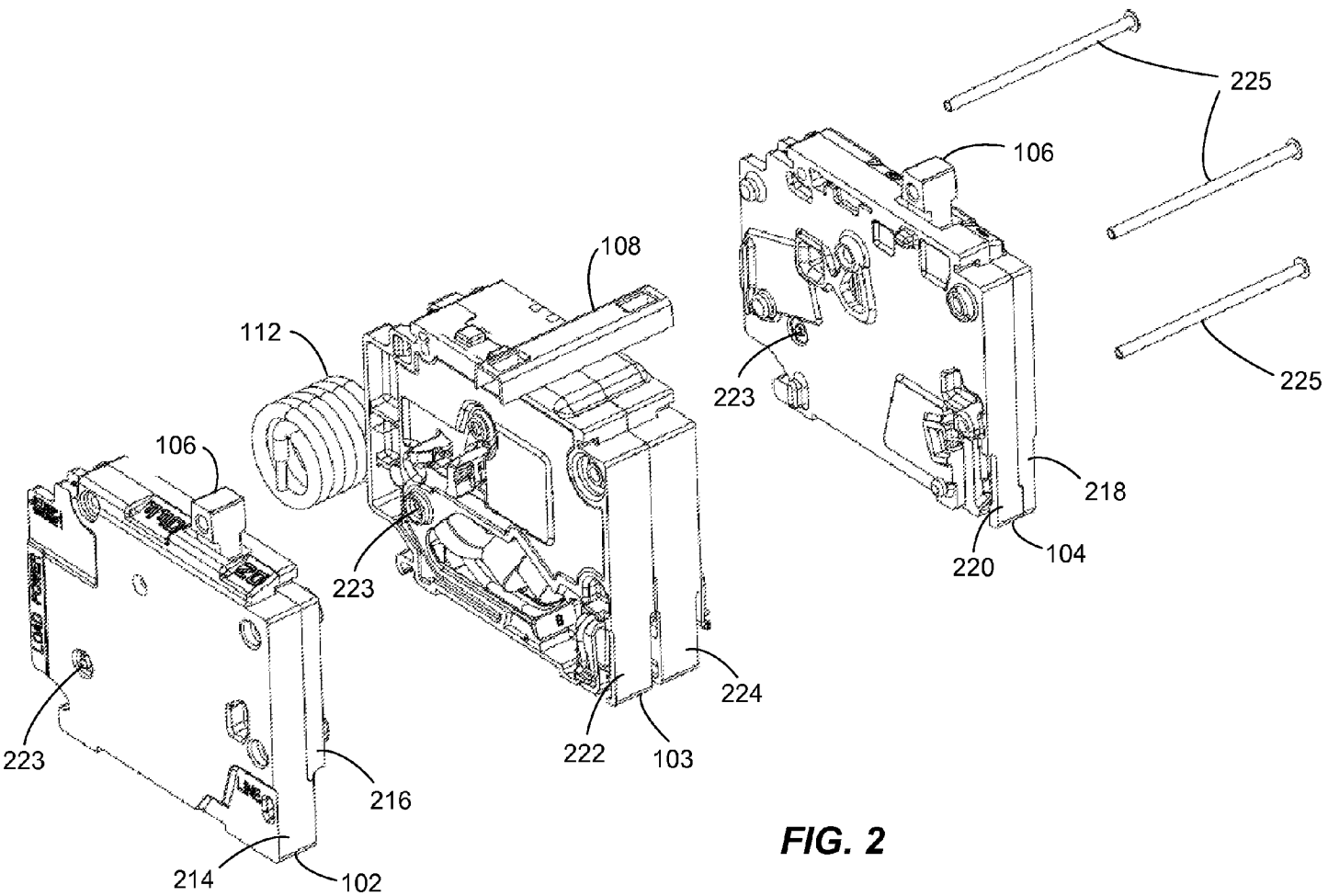
FIG. 2 illustrates a perspective exploded view of the two-pole circuit breaker of FIGS. 1A and 1B according to embodiments.

FIGS. 1A, 1B, and 2 illustrate a two-pole circuit breaker 100 in accordance with one or more embodiments. Two-pole circuit breaker 100 may include a first mechanical pole 102, a second mechanical pole 104, and an electronic pole 103 disposed between first mechanical pole 102 and second mechanical pole 104. As described in more detail below, first mechanical pole 102 and second mechanical pole 104 may each be configured to sense electrical faults such as short circuit and current overload conditions and respond thereto by tripping (i.e., interrupting power there through). Electronic pole 103 may be configured to sense electrical faults such as arc and/or ground faults in first and second mechanical poles 102 and 104 and respond thereto by causing one of the mechanical poles to trip.

First mechanical pole 102 and second mechanical pole 104 may each have a handle 106 that may be manually operated simultaneously with a handle tie bar 108 for tripping and/or resetting of two-pole circuit breaker 100. In some embodiments, electronic pole 103 may have one or more test buttons 110 (only one shown) for testing the electronic tripping circuitry therein. Two-pole circuit breaker 100 may have a neutral connector 112 (shown in FIGS. 1B and 2), which in some embodiments may be configured and referred to as a neutral "pigtail." Neutral connector 112 may connect to a neutral conductor inside of two-pole circuit breaker 100 and to a neutral bus (not shown) of a load center, such as, e.g., a circuit breaker panel.

In some embodiments, first and second mechanical poles 102 and 104 and electronic pole 103 may each be constructed as a respective module having two molded halves made of a thermal setting resin material with electrical insulating properties. For example, first mechanical pole 102 may include an outer module cover 214 and an inner module cover 216, second mechanical pole 104 may include an outer module cover 218 and an inner module cover 220, and electronic pole 103 may include a first module cover 222 and a second module cover 224. In some embodiments, one rivet 223 per module may be used to attach outer module cover 214 to inner module cover 216, outer module cover 218 to inner module cover 220, and first module cover 222 to second module cover 224. At final assembly, all three modules may be attached to each other in some embodiments via long rivets 225 (three of which are shown) and/or interlocking features (not shown) between the modules. First and second mechanical poles 102 and 104 and electronic pole 103 may be attached to each other in any other suitable manner to form two-pole circuit breaker 100.

Figure 3:
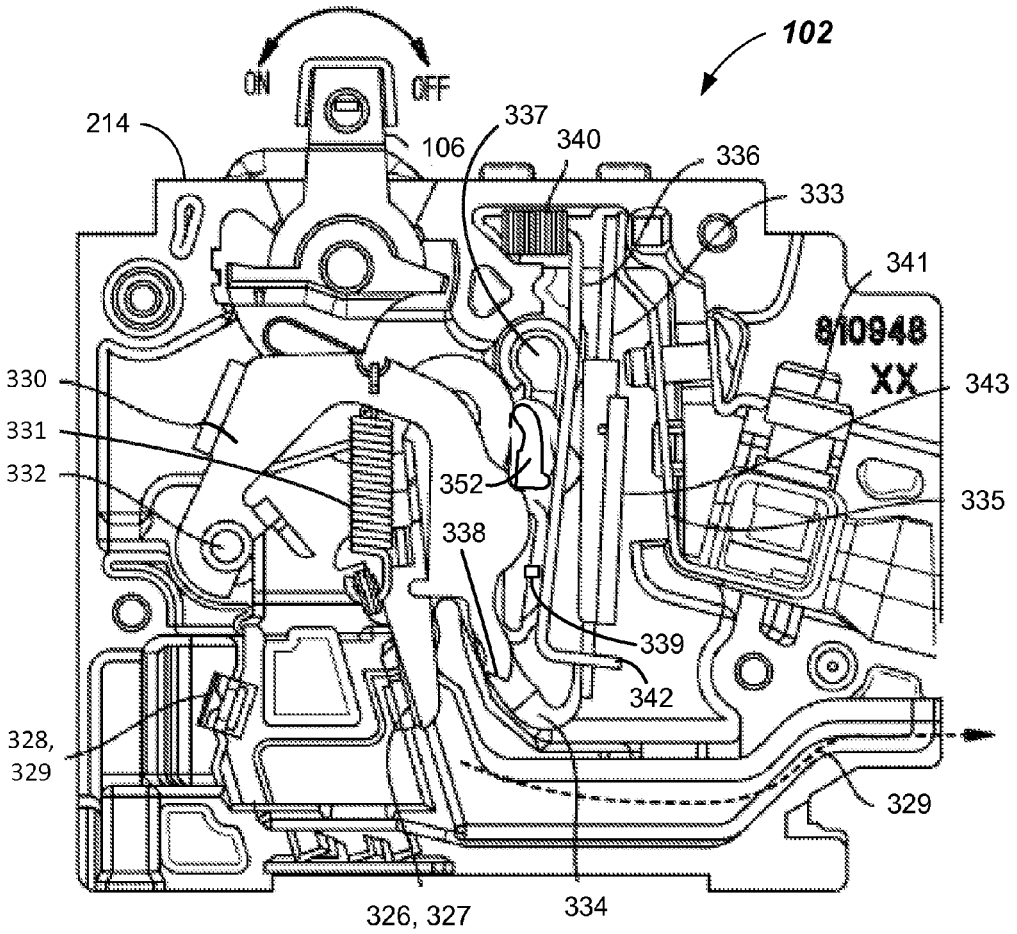
FIG. 3 illustrates an orthographic view of a mechanical pole (with several components omitted for clarity) according to embodiments.

FIG. 3 illustrates first mechanical pole 102 with inner module cover 216 removed to show various internal features in accordance with one or more embodiments. Second mechanical pole 104 may be constructed identically or similarly as first mechanical pole 102. First mechanical pole 102 may have one or more movable contacts 326 attached to movable bus 327 and one or more stationary contacts 328 attached to stationary bus 329. Movable contacts 326 and stationary contacts 328 are shown disconnected (i.e., in a tripped state). When connected, movable contacts 326 and stationary contacts 328 may feed received electrical power through first mechanical pole 102 to one or more loads coupled thereto. First mechanical pole 102 may include a gas channel 329 for venting gases that may result from movable contacts 326 disconnecting from stationary contacts 328 during a trip. Movable bus 327 may be connected to a cradle 330 via an extension spring 331. Cradle 330 may pivot about a cradle post 332, which may be a molded feature formed in outer module cover 214. Extension spring 331 may be used to generate the force that causes cradle 330 to rotate about cradle post 332 during a trip. An upper end of movable bus 327 may be connected to handle 106. To manually close (i.e., connect) movable contacts 326 and stationary contacts 328, handle 106 may be moved to the ON position, which causes movable bus 327 to rotate toward stationary contacts 328. To manually open (i.e., disconnect) movable contacts 326 and stationary contacts 328, handle 106 may be moved to the OFF position, which causes movable bus 327 to rotate away from stationary contacts 328, separating movable contacts 326 from stationary contacts 328.

Movable bus 327 may be connected to a bi-metal 333 via a flexible conductor 334. Bi-metal 333 may be part of an overload and short circuit tripping mechanism of first mechanical pole 102. A top end of bi-metal 333 may be connected to a load terminal 335 and captured by molded features in outer and inner module covers 214 and 216. The overload trip function may also include an armature 336 that may pivot about an armature pivot post 337, which may be a molded feature formed in outer module cover 214. The overload trip function may also include a cradle latch feature 338 located on cradle 330 and an armature latch feature 339 located on armature 336. As handle 106 rotates toward the OFF position, cradle 330 may rotate counterclockwise (toward handle 106). Cradle latch feature 338 may pass armature latch feature 339 on armature 336. Armature 336 may rotate clockwise toward cradle 330 via a compression spring 340 that may push on a top of armature 336 above armature pivot post 337. When handle 106 rotates toward the ON position, cradle 330 may rotate clockwise until cradle latch feature 338 engages and rests on armature latch feature 339. The overlap between cradle latch feature 338 and armature latch feature 339 may be referred to as the "latch bite," which allows movable contacts 326 and stationary contacts 328 to close.

During a current overload condition, bi-metal 333 may become heated from high current flowing through first mechanical pole 102. Bi-metal 333 may then rotate or deflect counterclockwise toward a load connector lug 341. Armature 336 may have a feature 342 that pulls armature 336 as bi-metal 333 rotates. This rotation may decrease the latch bite between cradle latch feature 338 and armature latch feature 339. When the latch bite becomes too small to maintain engagement between cradle latch feature 338 and armature latch feature 339, first mechanical pole 102 may "de-latch" or trip. That is, cradle 330 may rotate clockwise and extension spring 331 may cause movable bus 327 to rotate counterclockwise to separate movable contacts 326 from stationary contacts 328.

During a short circuit condition (which may be referred to as an instantaneous condition), armature 336 may be attracted to magnet 343 by a magnetic force. This may cause armature 336 to rotate in a counterclockwise direction and decrease the latch bite between cradle latch feature 338 and armature latch feature 339. As described above, when the latch bite becomes too small to maintain engagement between cradle latch feature 338 and armature latch feature 339, first mechanical pole 102 may "de-latch" or trip. Cradle 330 may then rotate clockwise and extension spring 331 may cause movable bus 327 to rotate counterclockwise to separate movable contacts 326 from stationary contacts 328.

Figure 4:
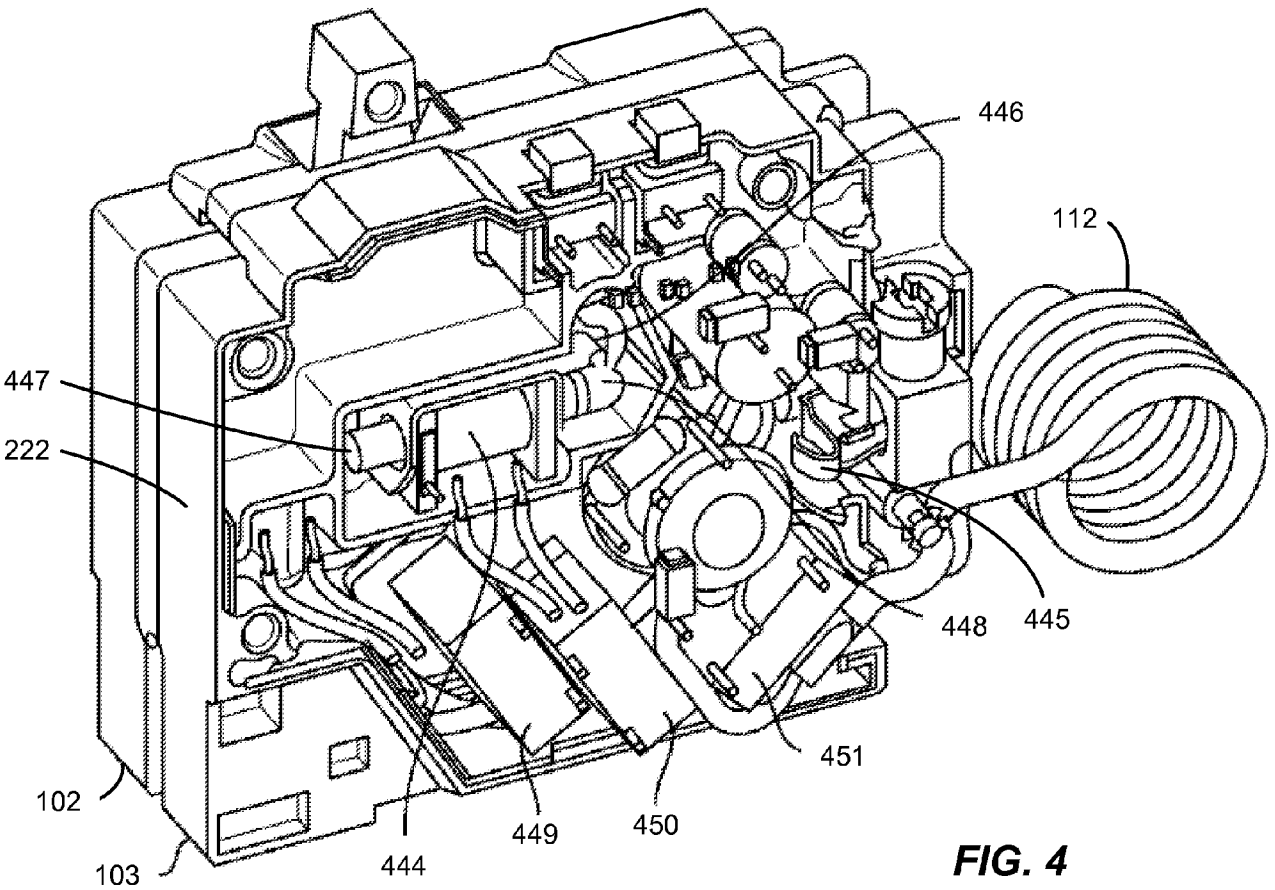
FIG. 4 illustrates a perspective view of an electronic pole (with several components omitted for clarity) according to embodiments.

FIG. 4 illustrates example circuitry components for electronic pole 103 in accordance with one or more embodiments. Electronic pole 103 may include a single wound solenoid 444 mounted on a circuit board (not shown). A connector 445 may be used to supply power to the circuit board by tapping into power provided at load terminal 335 (of FIG. 3). A feature 446 of armature 336 (of FIG. 3) from, e.g., first mechanical pole 102 may extend into electronic pole 103. In other embodiments, two-pole circuit breaker 100 may be constructed such that a feature 446 of armature 336 from second mechanical pole 104 may alternatively be used with electronic pole 103. Solenoid 444 may have a solenoid armature 447, which may have a molded insulated piece 448 attached to a tip thereof. Electronic pole 103 may also include a differential sensor 449 (which may also be known as a ground to line or ground fault toroid) and two arc fault toroids 450 and 451. Each arc fault toroid 450 and 451 may monitor current flowing through a respective one of first and second mechanical poles 102 and 104. Differential sensor 449 may determine whether a difference exists between arc fault toroids 450 and 451 and, if so, may send a signal to activate solenoid 444. When solenoid 444 activates, solenoid armature 447 may extend and contact armature feature 446 with molded insulated piece 448. This may cause armature 336 to rotate counterclockwise, unlatching cradle 330 and tripping first mechanical pole 102 as described above. In other embodiments, electronic pole 103 may alternatively or additionally include other suitable circuitry and/or components for sensing arc and/or ground electrical faults and for causing a predetermined one of first and second mechanical poles 102 and 104 to trip in response thereto. In other embodiments, mechanical poles 102 and 104 and electronic pole 103 may be configured wherein electronic pole 103 may directly cause a common trip in response to sensing an arc or ground fault condition, as described below in connection with FIG. 5A.

Two-pole circuit breaker 100 may include a trip bar 352 (as first shown in FIG. 3) configured to common trip the other of first and second mechanical poles 102 and 104 in response to the tripping of one of first and second mechanical poles 102 and 104. As better shown in FIGS. 5A, 5B, and 6, trip bar 352 may include a first lobe 502 located at one longitudinal end and a second lobe 504 located at the other longitudinal end of trip bar 352. Trip bar 352 may also include a first trip bar post 553 and a second trip bar post 554. First and second trip bar posts 553 and 554 may be received in corresponding trip bar journals that, in some embodiments, may be located respectively in electronic pole 103 and second mechanical pole 104, as described below in connection with FIGS. 7-9. In alternative embodiments, first and second trip bar posts 553 and 554 of trip bar 352 may be configured to be received in corresponding trip bar journals located respectively in, e.g., first mechanical pole 102 and electronic pole 103 or in first mechanical pole 102 and second mechanical pole 104.

First lobe 502 may have a first cradle interface 562 located on one side of first lobe 502 and a first armature interface 572 located on an opposite side of first lobe 502. Second lobe 504 may have a second cradle interface 564 located on one side of second lobe 504 and a second armature interface 574 located on an opposite side of second lobe 504. First lobe 502 and second lobe 504 may be configured identically. That is, first cradle interface 562 may be identical to second cradle interface 564, and first armature interface 572 may be identical to second armature interface 574. In other embodiments, first lobe 502 and/or second lobe 504 may be configured to conform to the configuration of components in respective mechanical poles in which first lobe 502 and/or second lobe 504 are mechanically coupled.

Figure 6:
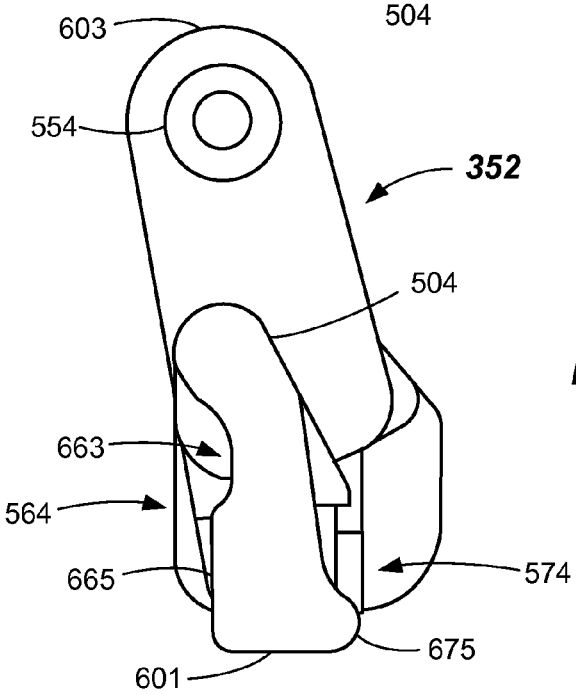
FIG. 6 illustrates a side profile view of the trip bar of FIGS. 5A and 5B according to embodiments.

FIG. 6 shows a side profile of second lobe 504. In some embodiments, a side profile of first lobe 502 may be identical to the side profile of second lobe 504. As shown, second cradle interface 564 may have a recessed surface 663 and a cradle contact surface 665 located below recess surface 663. Recessed surface 663 may be configured to allow cradle 330 to rotate further than in some known trip bars (i.e., by first passing recessed surface 663) before contacting cradle contact surface 665. This may allow cradle 330 to contact cradle contact surface 665 with greater force provided by extension spring 331. In some embodiments, cradle contact surface 665 may be shaped differently than shown in FIG. 6.

Second armature interface 574 may have a protruding armature contact surface 675. In some embodiments, protruding armature contact surface 675 may be located at a distal end 601 opposite a pivot end 603 of trip bar 352. Protruding armature contact surface 675 may be located at distal end 601 to decrease the force required to de-latch first and/or second mechanism poles 102 and/or 104 as compared with some known trip bars (an example of which is described below in connection with FIG. 13). Protruding armature contact surface 675 may also be sized to increase the de-latch bite over travel as compared with some known trip bars, which may reduce the adverse effects of surface wear on trip bar 352's ability to common trip. The increased de-latch bite over travel may also permit more generous trip bar design tolerances to be used than in some known trip bars. For example, design tolerances using a known trip bar may be about +/−0.002 inches, while design tolerances using trip bar 352 may be about +/−0.005 inches in some embodiments. In some embodiments, protruding armature contact surface 675 may be shaped differently at distal end 601 than shown in FIG. 6.

Figure 5A:
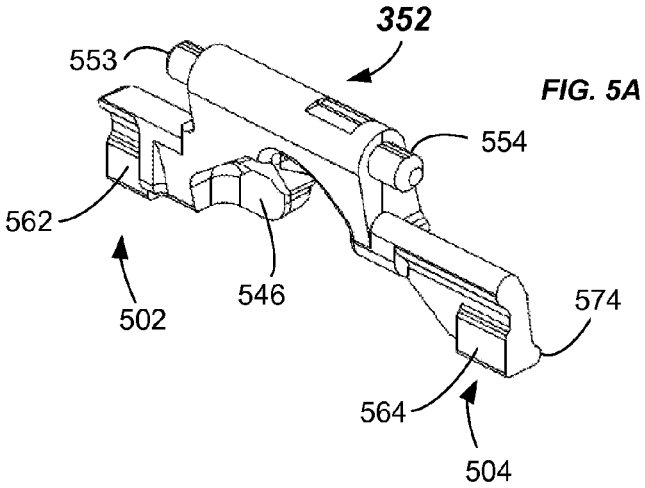
FIGS. 5A and 5B illustrate perspective left-side and right-side views, respectively, of a trip bar for a two-pole circuit breaker according to embodiments.

In some embodiments, trip bar 352 may also have a solenoid contact surface 546 (see FIG. 5A). Solenoid contact surface 546 may be located as shown adjacent to first lobe 502 and/or may be positioned to correspond to the location of a solenoid armature in one or more embodiments of electronic pole 103. For example, solenoid contact surface 546 may be configured to be used with solenoid armature 447 in one or more embodiments of electronic pole 103. In response to electronic pole 103 detecting an arc or ground fault condition, solenoid armature 447 may extend and contact solenoid contact surface 546 with molded insulated piece 448, instead of contacting armature feature 446, which may be omitted in these embodiments. The contact of solenoid contact surface 546 by solenoid armature 447 may cause trip bar 352 to rotate counterclockwise about first and second trip bar posts 553 and 554 (as oriented in FIG. 5A). The counterclockwise rotation of trip bar 352 may cause a common trip as described further below in connection with, e.g., FIGS. 10-12.

Figure 7:
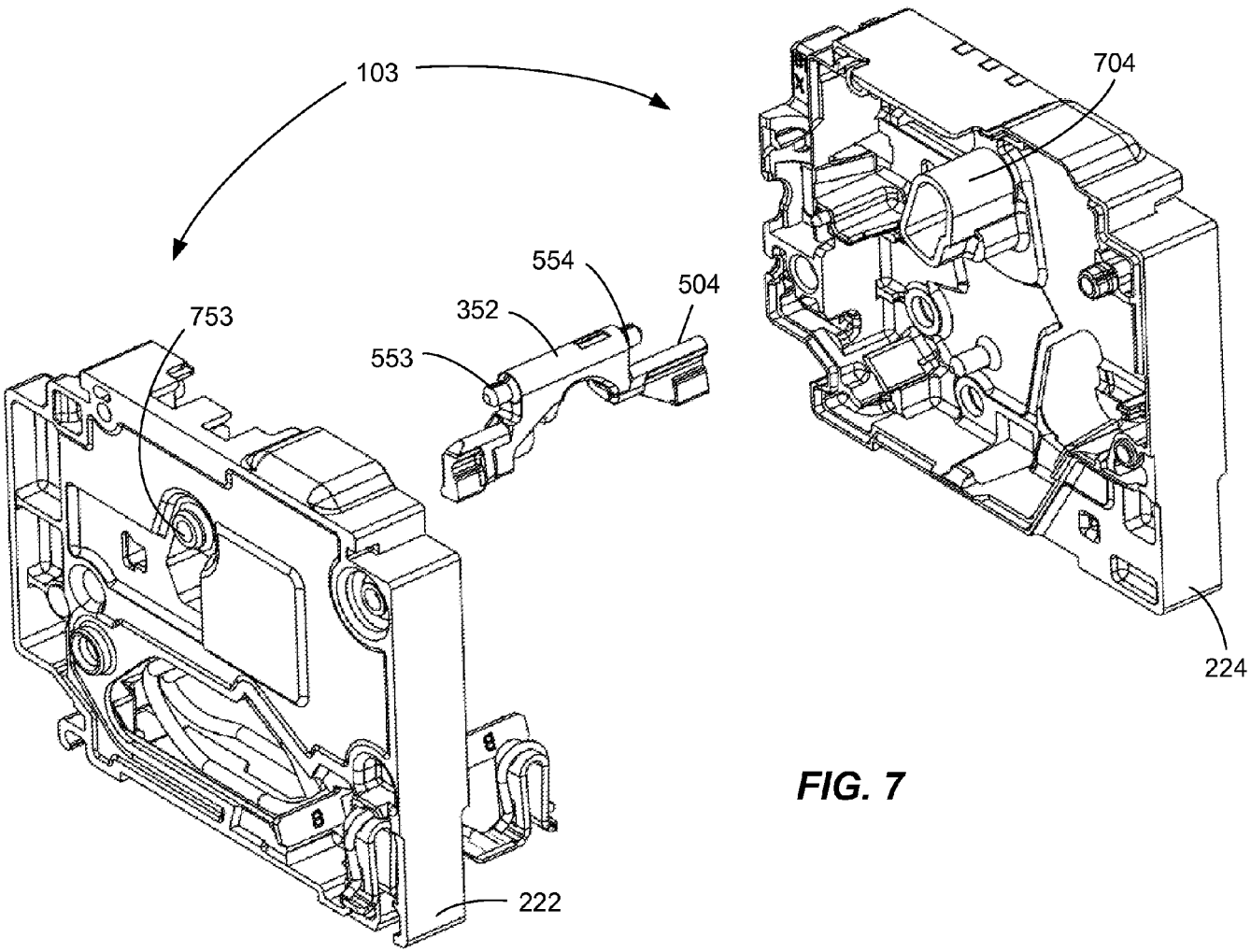
FIG. 7 illustrates a perspective exploded view of an electronic pole (with several components omitted for clarity) and a trip bar according to embodiments.
Figure 8:
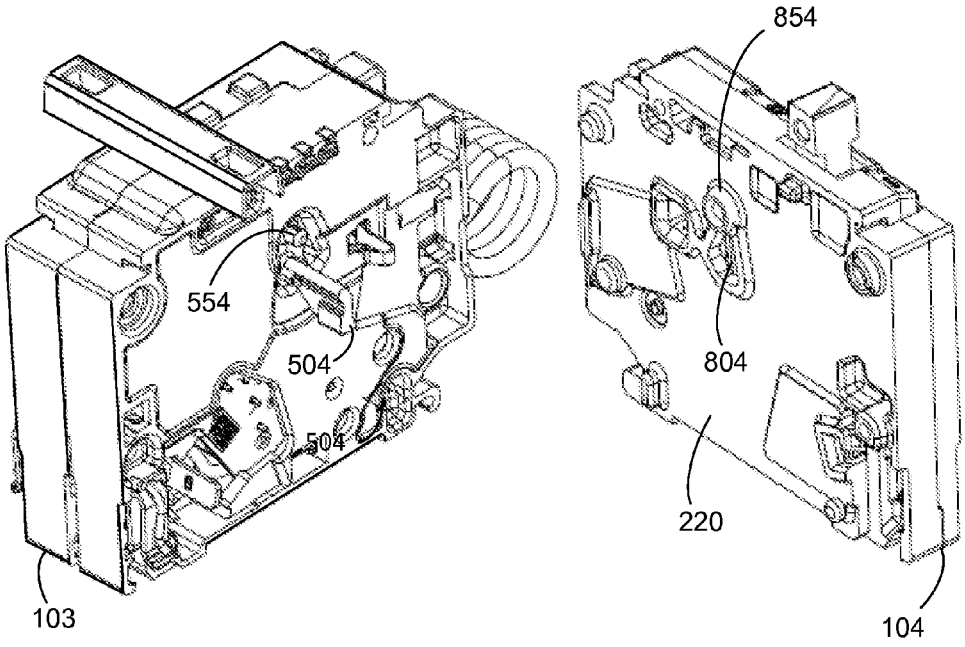
FIG. 8 illustrates a perspective view of an interface between an electronic pole and a second mechanical pole according to embodiments.
Figure 9:
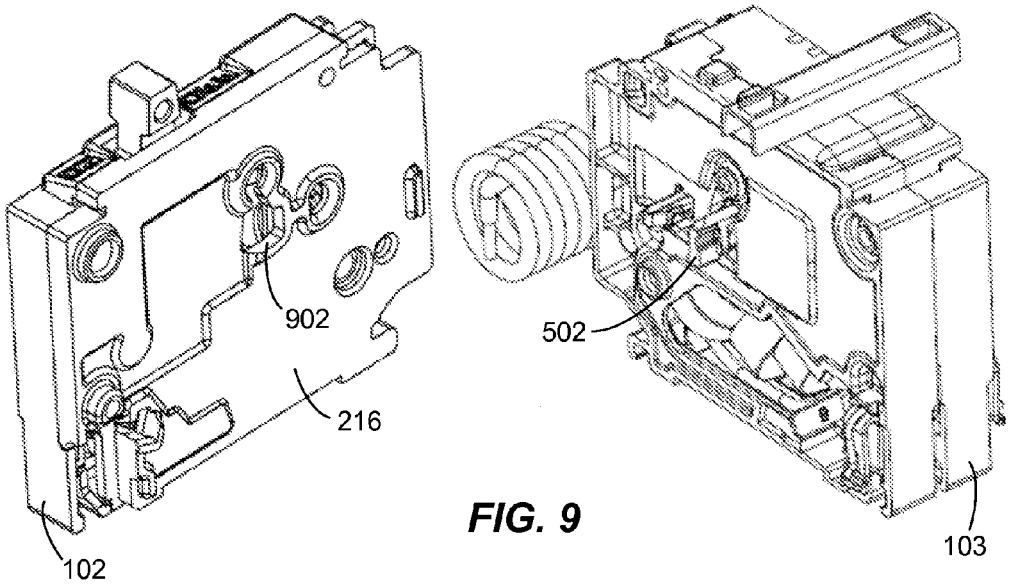
FIG. 9 illustrates a perspective view of an interface between a first mechanical pole and an electronic pole according to embodiments.

FIGS. 7-9 illustrate the mechanical coupling of trip bar 352 in circuit breaker 100 in accordance with one or more embodiments. Referring to FIG. 7, trip bar 352 may be partially received in first module cover 222 and second module cover 224 of electronic pole 103. In some embodiments, first module cover 222 may include a trip bar journal 753 configured to receive first trip bar post 553 of trip bar 352. Second lobe 504 and second trip bar post 554 may pass through a passageway 704 configured in second module cover 224 of electronic pole 103.

Referring to FIG. 8, second mechanical pole 104 may, in some embodiments, include a trip bar journal 854 configured to receive second trip bar post 554 extending through electronic pole 103. Second lobe 504 of trip bar 352, which also extends through electronic pole 103, may be received in second mechanical pole 104 through an opening 804 formed in inner module cover 220 of second mechanical pole 104.

As shown in FIG. 9, first lobe 502 of trip bar 352 may extend outward through electronic pole 103 and may be received in first mechanical pole 102 through an opening 902 formed in inner module cover 216 of first mechanical pole 102.

Returning briefly to FIG. 3, first lobe 502 of trip bar 352 may be received in first mechanical pole 102 between cradle 330 and armature 336, as shown in phantom. Second lobe 504 of trip bar 352 may be received in second mechanical pole 104 identically as shown for first lobe 502 in first mechanical pole 102 (i.e., between cradle 330 and armature 336 of second mechanical pole 104).

Figure 10:
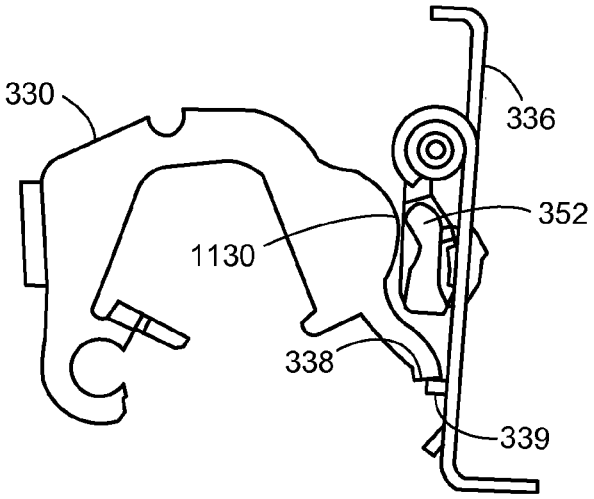
FIGS. 10-12 illustrate orthographic views of internal components of a mechanical pole in latched, partially-rotated, and fully-rotated positions, respectively, according to embodiments.
Figure 11:
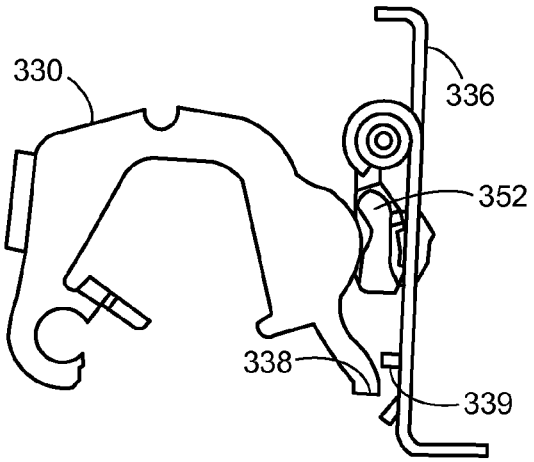
Figure 12:
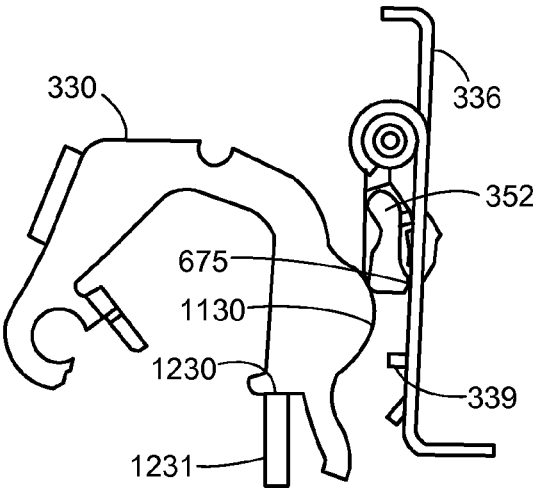

FIGS. 10-12 illustrate the mechanical relationship between cradle 330, trip bar 352 and armature 336 during a common trip in accordance with one or more embodiments. FIG. 10 illustrates cradle 330 in a latched position, wherein cradle latch feature 338 engages and rests on armature latch feature 339 and two-pole circuit breaker 100 may be feeding power to one or more loads. During a trip of, e.g., first mechanical pole 102, cradle 330 of first mechanical pole 102 may rotate as shown in FIG. 11. As cradle 330 rotates, protuberant cradle feature 1130 of cradle 330 may pass recessed surface 663 (FIG. 6) of first cradle interface 562 before contacting cradle contact surface 665 (FIG. 6). This may allow cradle 330 to rotate further and contact trip bar 352 with greater force provided by extension spring 331 than with some known trip bars. Contacting cradle contact surface 665 of trip bar 352 with greater force may improve the ability of trip bar 352 to perform a common trip in second mechanical pole 104.

As cradle 330 continues to rotate, protuberant cradle feature 1130 of cradle 330 may contact and push cradle contact surface 665 of trip bar 352. This may cause trip bar 352 to rotate counterclockwise about trip bar posts 553 and 554, causing second armature interface 574 to contact armature 336 in second mechanical pole 104. As trip bar 352 continues to rotate, protruding armature contact surface 675 of second armature interface 574 may cause the latch bite of cradle latch feature 338 and armature latch feature 339 of second mechanical pole 104 to shorten. Once this latch bite is too small to maintain (i.e., cradle latch feature 338 is no longer able to engage and rest on armature latch feature 339), second mechanical pole 104 may de-latch and trip, as described above in connection with FIG. 3.

FIG. 12 shows cradle 330 in a fully rotated position. Cradle rotation may stop once cradle stop 1230 engages a base stop 1231, which may be configured in each of first and second mechanical poles 102 and 104. When cradle rotation has stopped, protuberant cradle feature 1130 of cradle 330 may still be in contact with cradle contact surface 665 of trip bar 352. This may result in protruding armature contact surface 675 of second armature interface 574 continuing to apply force to armature 336 of second mechanical pole 104, which may increase the counterclockwise rotation of armature 336. The de-latch bite over travel between cradle latch feature 338 and armature latch feature 339 may therefore increase, providing the benefits of reliable common tripping and greater allowable design tolerances. Also, because protruding armature contact surface 675 may be configured at distal end 601, protruding armature contact surface 675 may contact armature 336 at a lower point (as shown) on armature 336 than some known trip bars. That is, protruding armature contact surface 675 may contact armature 336 at a point farther away from armature pivot post 337 than known trip bars. This may decrease the force required on trip bar 352 to de-latch first and second mechanical poles during a trip, as illustrated by the example below in connection with FIG. 13.

Figure 13:
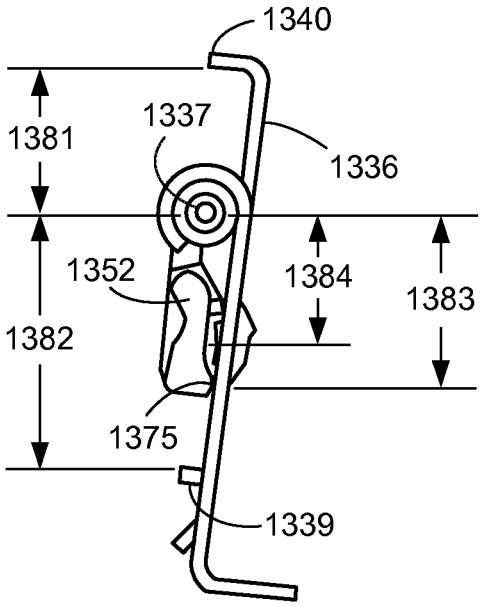
FIG. 13 illustrates an orthographic view of a trip bar and an armature according to embodiments.

FIG. 13 illustrates a trip bar 1352 positioned in relation to an armature 1336 of a mechanical pole, which may be, e.g., either of first and second mechanical poles 102 and 104, in accordance with one or more embodiments. Armature 1336 may have an armature pivot post 1337, an armature latch feature 1339, and a top section 1340. Armature pivot post 1337 may be a distance 1381 from top section 1340. Distance 1381 may be about 0.429 inches in some embodiments. Armature latch feature 1339 may be a distance 1382 from armature pivot post 1337. Distance 1382 may be about 0.760 inches in some embodiments. Protruding armature contact surface 1375 of trip bar 1352, which may be configured to contact armature 1336 during a trip, may be a distance 1383 from armature pivot post 1337. Distance 1383 may be about 0.516 inches in some embodiments. In comparison, a known trip bar having a lobe with a substantially triangular side profile shape may have a distance 1384 of about 0.390 inches from its armature contact surface to armature pivot post 1337. Because the moment arm of armature 1336 represented by distance 1383 is longer than distance 1384, trip bar 1352 may require about 25% less force than the known trip bar to de-latch a mechanical pole.

In various embodiments, two-pole circuit breaker 100 may be a GFCI (ground fault circuit interrupter), an AFCI (arc fault circuit interrupter), or a CAFCI (combination arc fault circuit interrupter). In some embodiments, two-pole circuit breaker 100 may be a thermal/magnetic two-pole circuit breaker, wherein only first and second mechanical poles 102 and 104 may be included and electronic pole 103 may be omitted. In some of the thermal/magnetic breaker embodiments, a longitudinally shorter embodiment of trip bar 352 having the same first and second lobes 502 and 504 and associated interface features thereof may be mechanically coupled to first and second mechanical poles 102 and 104, which may be directly attached to each other (i.e., no electronic pole 103) resulting in a narrower-width two-pole circuit breaker. In other thermal/magnetic breaker embodiments, trip bar 352 may be mechanically coupled to first and second mechanical poles 102 and 104, which may be attached to respective first and second module covers 222 and 224 (but without electronic pole 103 circuitry and/or components therein), resulting in a two-pole thermal/magnetic circuit breaker having the same width as that shown herein for two-pole circuit breaker 100.

As also shown herein, trip bar 352 may not be symmetrically shaped between first and second lobes 502 and 504. The shape of trip bar 352 between first and second lobes 502 and 504 may depend in large part on the construction of electronic pole 103 and on whether electronic pole 103 is included in two-pole circuit breaker 100. Accordingly, in some embodiments, trip bar 352 may be shaped differently between first and second lobes 502 and 504 than that shown herein.

Figure 14:
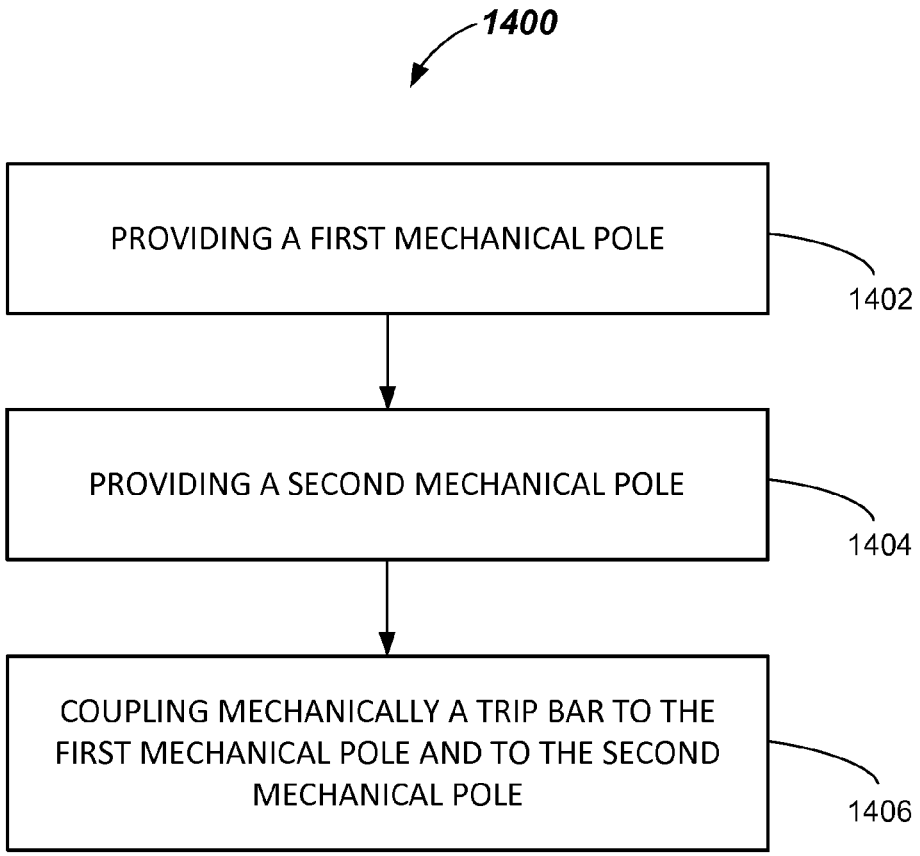
FIG. 14 illustrates a flowchart of a method of assembling a two-pole circuit breaker according to embodiments.

FIG. 14 illustrates a method 1400 of assembling a two-pole circuit breaker in accordance with one or more embodiments. At process block 1402, method 1400 may include providing a first mechanical pole that may include a first armature and a first cradle. The first mechanical pole may be configured to trip in response to sensing an electrical fault. The electrical fault may be, e.g., a short circuit or a current overload condition. For example, in some embodiments, the first mechanical pole may be first mechanical pole 102 that includes cradle 330 and armature 336, as shown in FIGS. 1-3.

At process block 1404, method 1400 may include providing a second mechanical pole comprising a second armature and a second cradle. The second mechanical pole may be configured to trip in response to sensing an electrical fault. In some embodiments, the second mechanical pole may be constructed identically or substantially similarly as first mechanical pole 102. For example, the second mechanical pole may be shown as a mirror image of FIG. 3.

Figure 5B:
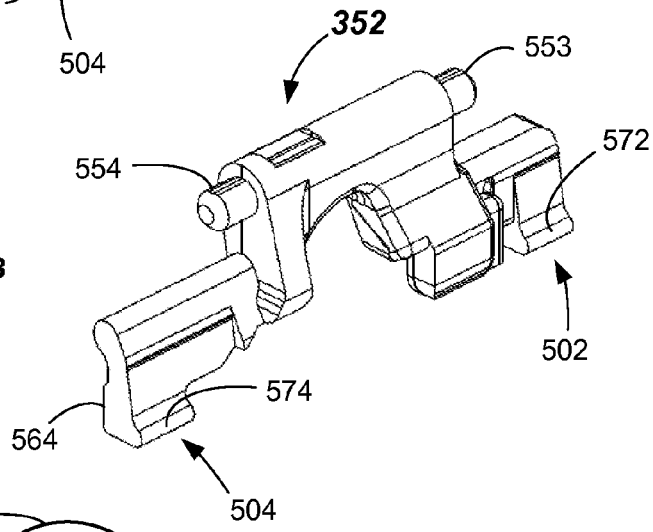

At process block 1406, coupling mechanically one end of a trip bar to the first mechanical pole and another end of the trip bar to the second mechanical pole may be performed. In some embodiments, the trip bar may have a first cradle interface having a first recessed surface and a first cradle contact surface, wherein one of the first and second cradles may be configured to move past the first recessed surface before contacting the first cradle contact surface during a trip. For example, as shown in FIGS. 5A, 5B, and 6, the trip bar may be trip bar 352. Trip bar 352 may have one end with first lobe 502 and another end with second lobe 504. Each lobe 502 and 504 may have a recessed surface 663 and cradle contact surface 665. As shown in FIGS. 3 and 5A-10, each lobe 502 and 504 of trip bar 352 may extend into and mechanically couple to a respective one of first and second mechanical poles 102 and 104 between respective cradles 330 and armatures 336 thereof.

The above process blocks of method 1400 may be executed or performed in an order or sequence not limited to the order and sequence shown and described. For example, in some embodiments, process block 1402 may be performed after or in parallel with process block 1404.

Persons skilled in the art should readily appreciate that the invention described herein is susceptible of broad utility and application. Many embodiments and adaptations of the invention other than those described herein, as well as many variations, modifications, and equivalent arrangements, will be apparent from, or reasonably suggested by, the invention and the foregoing description thereof, without departing from the substance or scope of the invention. For example, although described in connection with circuit breakers, one or more embodiments of the invention may be used with other types of devices that require a common tripping or activation function and/or mechanism. Accordingly, while the invention has been described herein in detail in relation to specific embodiments, it should be understood that this disclosure is only illustrative and presents examples of the invention and is made merely for purposes of providing a full and enabling disclosure of the invention. This disclosure is not intended to limit the invention to the particular apparatus, devices, assemblies, systems or methods disclosed, but, to the contrary, the intention is to cover all modifications, equivalents, and alternatives falling within the scope of the invention.

What is claimed is:

1. A two-pole circuit breaker, comprising:

a first mechanical pole comprising a first armature and a first cradle, the first mechanical pole configured to trip in response to sensing an electrical fault;

a second mechanical pole comprising a second armature and a second cradle, the second mechanical pole configured to trip in response to sensing an electrical fault; and a trip bar mechanically coupled to the first and second mechanical poles, the trip bar configured to trip one of the first and second mechanical poles in response to the other of the first and second mechanical poles tripping, the trip bar having a first cradle interface having a first recessed surface and a first cradle contact surface; wherein:

one of the first and second cradles is configured to move past the first recessed surface before contacting the first cradle contact surface during a trip.

2. The two-pole circuit breaker of claim 1, wherein the trip bar has a second cradle interface having a second recessed surface and a second cradle contact surface, wherein the other of the first and second cradles is configured to move past the second recessed surface before contacting the second cradle contact surface during a trip.

3. The two-pole circuit breaker of claim 1, wherein the trip bar has a pivot end and a distal end opposite the pivot end, the trip bar having a first armature interface that has a first protruding armature contact surface at the distal end.

4. The two-pole circuit breaker of claim 3, wherein the trip bar has a first lobe that extends into and mechanically couples to one of the first and second mechanical poles, the first lobe comprising the first cradle interface and the first armature interface.

5. The two-pole circuit breaker of claim 4, wherein the first cradle interface and the first armature interface are disposed on opposite sides of the first lobe.

6. The two-pole circuit breaker of claim 3, wherein the trip bar has a second armature interface that has a second protruding armature contact surface at the distal end.

7. The two-pole circuit breaker of claim 6, wherein the trip bar has a second lobe that extends into and mechanically couples to the other of the first and second mechanical poles, the second lobe comprising the second cradle interface and the second armature interface disposed on opposite sides of the second lobe.

8. The two-pole circuit breaker of claim 1, further comprising an electronic pole disposed between the first and second mechanical poles, the electronic pole configured to sense and respond to an electrical fault by causing one of the first and second mechanical poles to trip, the trip bar extending between the first and second mechanical poles through the electronic pole.

9. The two-pole circuit breaker of claim 1, wherein the electrical fault comprises a short circuit, a current overload, a ground fault, or an arc fault condition.

10. A two-pole circuit breaker, comprising:

a first mechanical pole comprising a first armature and a first cradle, the first mechanical pole configured to trip in response to sensing an electrical fault;

a second mechanical pole comprising a second armature and a second cradle, the second mechanical pole configured to trip in response to sensing an electrical fault;

a trip bar mechanically coupled to the first and second mechanical poles, the trip bar configured to trip one of the first and second mechanical poles in response to the other of the first and second mechanical poles tripping, the trip bar having a pivot end and a distal end opposite the pivot end, the trip bar having a first armature interface that has a first protruding armature contact surface at the distal end, and a solenoid contact surface; and an electronic pole located between the first and second mechanical poles such that the trip bar extends through the electronic pole, wherein the solenoid contact surface is configured to be contacted by a solenoid armature to cause a common trip of the first and second mechanical poles.

11. The two-pole circuit breaker of claim 10, wherein the trip bar has a second armature interface that has a second protruding armature contact surface at the distal end.

12. The two-pole circuit breaker of claim 10, wherein the trip bar has a first cradle interface having a first recessed surface and a first cradle contact surface, and one of the first and second cradles is configured to move past the first recessed surface before contacting the first cradle contact surface during a trip.

13. The two-pole circuit breaker of claim 12, wherein the trip bar has a second cradle interface having a second recessed surface and a second cradle contact surface, and the other of the first and second cradles is configured to move past the second recessed surface before contacting the second cradle contact surface during a trip.

14. The two-pole circuit breaker of claim 13, wherein the trip bar comprises:

a first lobe extending into and mechanically coupling to one of the first and second mechanical poles, the first lobe comprising the first cradle interface and the first armature interface disposed on opposite sides of the first lobe; and a second lobe extending into and mechanically coupling to the other of the first and second mechanical poles, the second lobe comprising the second cradle interface and a second armature interface disposed on opposite sides of the second lobe, the second cradle interface having a second protruding armature contact surface at the distal end.

15. A method of assembling a two-pole circuit breaker, comprising:

providing a first mechanical pole comprising a first armature and a first cradle, the first mechanical pole configured to trip in response to sensing an electrical fault;

providing a second mechanical pole comprising a second armature and a second cradle, the second mechanical pole configured to trip in response to sensing an electrical fault; and coupling mechanically one end of a trip bar to the first mechanical pole and another end of the trip bar to the second mechanical pole, the trip bar having a first cradle interface having a first recessed surface and a first cradle contact surface, wherein one of the first and second cradles is configured to move past the first recessed surface before contacting the first cradle contact surface during a trip.

16. The method of claim 15, wherein the coupling mechanically comprises inserting a first trip bar post formed on the trip bar into a first trip bar journal located in one of the first and second mechanical poles.

17. The method of claim 15, wherein the method further comprises coupling an electronic pole between the first and second mechanical poles such that the trip bar extends through the electronic pole.

18. The method of claim 17, wherein the coupling mechanically comprises inserting a second trip bar post formed on the trip bar into a second trip bar journal located in the electronic pole.

19. The method of claim 15, wherein the coupling mechanically comprises inserting a first lobe of the trip bar between the first cradle and the first armature, the first lobe comprising the first cradle interface.

20. The method of claim 15, wherein the coupling mechanically comprises inserting a first lobe of the trip bar between the first cradle and the first armature, the trip bar having a pivot end and a distal end opposite the pivot end, and the first lobe comprising a first armature interface that has a first protruding armature contact surface at the distal end.

* * * * *